US006663228B2

(12) United States Patent
Saito et al.

(10) Patent No.: US 6,663,228 B2
(45) Date of Patent: Dec. 16, 2003

(54) INK-JET HEAD BASE BOARD, INK-JET HEAD, AND INK-JET APPARATUS

(75) Inventors: Ichiro Saito, Kanagawa-ken (JP); Masahiko Ogawa, Tokyo (JP); Teruo Ozaki, Kanagawa-ken (JP); Masahiko Kubota, Tokyo (JP); Muga Mochizuki, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/253,939

(22) Filed: Sep. 25, 2002

(65) Prior Publication Data

US 2003/0103111 A1 Jun. 5, 2003

Related U.S. Application Data

(62) Division of application No. 09/677,866, filed on Oct. 3, 2000, now Pat. No. 6,485,131.

(30) Foreign Application Priority Data

Oct. 4, 1999 (JP) ..... 11-283540

(51) Int. Cl.[7] ..... B41J 2/05
(52) U.S. Cl. ..... 347/64
(58) Field of Search ..... 347/56, 63, 64, 347/54, 61, 67; 216/27, 4, 48; 29/890.1; 430/311

(56) References Cited

U.S. PATENT DOCUMENTS 4,723,129 A 2/1988 Endo et al. ..... 347/56
4,740,796 A 4/1988 Endo et al. ..... 347/56
5,660,739 A * 8/1997 Ozaki et al.
5,896,147 A 4/1999 Mori et al. ..... 347/61

FOREIGN PATENT DOCUMENTS

| | | | |
|---|---|---|---|
| EP | 0318981 | 6/1989 | ..... B41J/3/04 |
| EP | 0353925 | 2/1990 | ..... B41J/2/16 |
| EP | 0490668 | 6/1992 | ..... B41J/2/16 |
| EP | 0899104 | 3/1999 | ..... B41J/2/05 |
| GB | 2151555 | 7/1985 | ..... B41J/3/04 |
| JP | 215158 A | 6/1990 | ..... A23L/1/05 |

* cited by examiner

*Primary Examiner*—Juanita Stephens
(74) *Attorney, Agent, or Firm*—Fitzpatrick, Cella, Harper & Scinto

(57) ABSTRACT

A base member for an ink jet head, the base member comprising a substrate, a heat generating resistor provided between electrodes which constitute a pair on the substrate an upper protection layer provided on an insulation layer which in turn is provided on the heat generating resistor, the upper protection layer having a contact surface contactable to ink, the improvement residing in that the upper protection layer is made of amorphous alloy having a following composition formula:

$Ta\alpha Fe\beta Ni\gamma Cr\delta$ where 10 atomic $\% \leqq \alpha \leqq 30$ atomic %, $\alpha+\beta<80$ atomic % $\alpha<\beta$, $\delta>\gamma$ and, $\alpha+\beta+\gamma+\delta=100$ atomic %, and, at least the contact surface of the upper protection layer contains an oxide of a constituent component.

14 Claims, 7 Drawing Sheets

INK-JET HEAD BASE BOARD, INK-JET HEAD, AND INK-JET APPARATUS

This application is a division of application Ser. No. 09/677,866, filed on Oct. 3, 2000, U.S. Pat. No. 6,485,131.

FIELD OF THE INVENTION AND RELATED ART

The present invention relates to a base board for forming an ink-jet head (hereinafter, it may be referred to "head" for simplicity) which prints letters, signs, images, or the like on recording medium such as paper, plastic sheet, fabric, ordinary objects, and the like, by ejecting functional liquid, for example, ink, onto the recording medium. It also relates to an ink-jet head comprising such a base board, a recording unit, for example, an ink-jet pen, comprising an ink storage portion for storing the ink supplied to such an ink-jet head, and an ink-jet apparatus in which such an ink-jet head is installed.

There are various configuration for a recording unit, such as an ink-jet pen, in accordance with the present invention. One of such configurations is a cartridge. A cartridge may comprise an integral or independent combination of an ink-jet head and an ink storing portion. An ink-jet recording unit is structured so that it can be removably mounted on a carrying means, and as a carriage, on the main assembly side of an image forming apparatus.

An ink-jet apparatus with which the present invention is compatible includes a copying apparatus combined with an information reading device or the like, a facsimile apparatus enabled to send or receive information, a machine for printing on fabric, and the like, in addition to an ink-jet apparatus integrated, as an output terminal, with an information processing device such as a word processor, a computer, or the like.

Ink-jet recording apparatuses are distinctive in that they can print highly precise images at a high speed by ejecting ink in the form of a microscopic droplet from orifices. Recently, such ink-jet recording apparatuses that employ electrothermal transducers, which have a portion formed of exothermic resistant material, as a means for generating the energy used for ejecting ink, and that use the bubbling, that is, boiling, or ink caused by the thermal energy generated by the electrothermal transducers, have been attracting attention, because they are particularly suitable for forming high precision images, are capable of recording at a high speed, and make it possible to reduce in size, and/or colorize a recording head as well as a recording apparatus (for example, those disclosed in U.S. Pat. Nos. 4,723,129 and 4,740,796).

Generally, a head used for ink-jet recording comprises: a plurality of ejection orifices; a plurality of ink paths leading to the ejection orifices one for one; and a plurality of electrothermal transducers for generating the thermal energy used for ejecting ink. Each electrothermal transducer has an exothermic resistant portion and electrodes, and is coated with electrically insulative film so that it is insulated from the others. Each ink path is connected to a common liquid chamber, at the side opposite to the ejection orifice. In the common liquid chamber, the ink supplied from an ink container as an ink holding portion is stored. After being supplied into the common liquid chamber, ink is led into each of the ink paths, and is retained therein, forming a meniscus adjacent to the outward edge of the ejection orifices. While the head is in this state, the thermal energy generated by selectively driving the electrothermal transducers is used to suddenly heat the ink in contact with the surface of the driven electrothermal transducer to boil the ink. As the ink boils, or the state of the ink changes from liquid to gas, pressure is generated, and ink is ejected by this pressure.

When ink is ejected, the portion of the ink-jet head, which thermally interacts with ink, is subjected to not only the intense heat generated by the exothermic resistant material, but also the shocks (cavitation shocks) caused by the formation and collapsing of ink bubbles. Also, it is chemically affected by the ink itself. In other words, it is subjected to the compound effects of those factors.

Thus, this thermally interactive portion of the ink-jet head is generally covered with a top portion protecting layer for protecting the electrothermal transducer from the cavitation shocks, and also for preventing ink from chemically affecting the electrothermal transducer.

Next, referring to FIG. 3, the generation and collapse of a bubble on the aforementioned thermally interactive portion, and the related matters, will be described in detail.

A curved line (a) in FIG. 3 shows the change in the surface temperature of the top portion protecting layer, which began the moment a voltage Vop (pulse), which was 1.3× Vth (Vth is the threshold voltage at which ink began boiling) in amplitude, 6 kHz in driving frequency, and 5 $\mu$sec in pulse width, was applied to a heat generating member (exothermic resistant member). A curved line (b) in FIG. 3 shows the growth of the generated bubble, which began the moment the voltage was applied to the heat generating member. As the curved line (a) shows, the temperature began to rise after the application of the voltage, and reached its peak slightly after the end of the pulse with a predetermined duration (it took a short time for the heat from the heat generating member to reach the top portion protecting layer). After reaching its peak, it began to fall due to heat dissipation. On the other hand, as shown by the curved line (b), the bubble began to grow when the temperature of the top portion protecting layer reached approximately 300° C., and began collapsing after reaching its maximum size. In an actual operation, the above described process was repeated in the head. The surface temperature of the top portion protecting layer reached nearly 600° C., for example, as the bubble grew. In other words, it is evident from FIG. 3 how high the level was of the temperature at which ink-jet recording was carried out.

The top portion protecting layer which comes into contact with ink is required to be superior in heat resistance, mechanical strength, chemical stability, oxidization resistance, alkali resistance, and the like properties. As to the material for the top portion protecting layer, precious metals, transition metals with a high melting point, their alloys, nitride, boride, silicide, carbide, amorphous silicon, and the like have been known.

For example, Laid-Open Japanese Patent No. 145158/1990 proposes a recording head superior in durability and reliability, which is realized by placing a top layer formed of Mx $(Fe_{100-y-x}Ni_yCr_z)_{100-x}$ (M stands for one or more elements selected from among Ti, Zr, Hf, Hb, Ta, and W; and x, y and z stand for atom percentages (at. %) in a range of 20–70 at. %, a range of 5–30 at. %, and a range of 10–30 at. %, correspondingly), of the insulative layer which is on the exothermic resistance layer.

In recent years, demands have been increasing for further improvement of an ink-jet recording apparatus in terms of image quality and recording speed, and in order to realize an ink-jet recording apparatus which satisfies these demands, various attempts have been made to improve an ink-jet recording apparatus in many aspects, for example, the head structure, and also to improve the ink itself.

FIG. 2 illustrates an example of the structure of a base board, that is, one of the portions which make up an ink-jet head.

In the base board illustrated in FIG. 2(*a*), a protective layer 2006 and a top portion protecting layer 2007 are accumulated on an electrothermal transducer which is made up of an exothermic resistance layer 2004 and an electrode layer 2005. The base board illustrated in FIG. 2(*b*) is a version of the base board illustrated in FIG. 2(*a*), in which the protective layer has been improved. More specifically, the protective layer of the base board illustrated in FIG. 2(*b*) has been divided into two sub-layers so that the thermal energy from the exothermic resistant layer 2004 acts more effectively upon ink at a thermally interactive portion 2008. Further, the thickness of the protective layer has been reduced, below the thermally interactive portion 2008. When producing the base board illustrated in FIG. 2(*b*), first, a first protective sub-layer 2006 is formed of SiO, SiN, or the like, and then, this first protective sub-layer 2006 is removed only from the area, the position of which corresponds to that of the thermally interactive portion in terms of the vertical direction, by patterning or the like. Then, a second protective sub-layer 2002 is formed of SiO, SiN, or the like. As a result, the overall thickness of the protective layer becomes thinner below the thermally interactive portion 2008. Lastly, a top portion protective layer 2007 is formed.

The protective layer on the electrothermal transducer in a base board such as the one described above is required to be electrically insulative, and resistant to ink. It is also required to be resistant to cavitation shocks which occur during ink ejection. If the thickness of the protective layer is substantially increased as shown in FIG. 2(*a*), the level of the quality which the material for the protective layer requires in terms of the protective performance may be somewhat lowered; in other words, materials which are not perfect for preventing the exothermic resistant layer from being damaged by the cavitation shocks during ink ejection, or from being corroded by ink, can be used as the material for the protective layer. This is due to the fact that the thicker the protective layer, the longer the time necessary for the damage or corrosion to reach the exothermic resistant layer, and therefore, the longer the service life of the head.

Meanwhile, ink has been improved to control bleeding (bleeding between two areas different in color) in order to deal with high speed recording. Ink is also improved in terms of saturation, water resistance, and the like in order to meet the demands for high image quality. Such improvements have been made with the use of additives. When such improved ink, in particular, ink which contains ingredients, such as Ca and Mg, capable of forming bivalent metallic salt, or chelate complex, is used, the protective layer tends to be corroded through a thermochemical reaction which occurs between the protective layer and ink. Increasing the thickness of the protective layer is also effective to extend the service life of an ink-jet head used with such ink.

However, increasing the thickness of the protective layer results in the reduction in the efficiency with which the thermal energy generated in the exothermic resistant layer conducts to the thermally interactive surface.

Thus, the protective layer is reduced in thickness across the area correspondent to the thermally interactive portion as shown in FIG. 2(*b*), so that the the thermal energy from the exothermic resistant layer 2004 can be more effectively conducted to ink through the second protective sub-layer 2006' and the top portion protecting layer 2007 to improve thermal efficiency.

However, if the protective layer is reduced in thickness, the damages caused to the thermally interactive portion by the cavitation shock and/or the corrosive effect of ink, reach the exothermic resistant layer more quickly than when the protective layer is not reduced in thickness, although this depends upon the type of the protective layer material. In other words, reducing the thickness of the protective layer is detrimental to the extension of the service life of the head. In particular, when an ink which contains ingredients such as Ca or Mg capable of forming bivalent salts or chelate complexes is used as described above, the above described phenomenon becomes more intense. Thus, when such an ink is used, the material for the protective layer must be far more strictly selected.

In order to further increase the speed of an ink-jet recording, it is necessary to use a driving pulse far shorter in which than the conventional driving pulse; in other words, it is necessary to increase driving frequency. When a driving pulse with such a short width is used, a cyclic of heating→bubble development→bubble collapse→cooling is repeated across the thermally interactive portion of the head at a higher frequency compared to when the conventional pulse is used. In other words, when a driving pulse with such a short width is used, the thermally interactive portion of the head is subjected to thermal stress at a higher frequency. Further, driving the head with a pulse with a shorter width causes the protective layer to be subjected to a greater concentration of cavitation shocks generated by the generation and collapse of bubbles in ink in a shorter time. Therefore, when a driving pulse with the shorter width is used, the protective layer must be far superior in terms of resistance to mechanical shocks.

Although a head structure such as the one illustrated in FIG. 2(*b*) which employs a thinner protective layer is suitable for driving a head with a pulse with a shorter width, the thinner protective layer is no different from the thicker one in that it is required to be resistant to the cavitation shocks, resistant to ink such as the one described above which has been improved to provide better image quality, and also sufficiently resistant to the thermal stress peculiar to the usage of a driving pulse with a shorter width.

Presently, however, such a protective layer structure that makes it possible for a variety of inks to satisfactorily used, is capable of dealing with a recording speed much higher than the conventional one, and is capable of contributing to the extension of the service life of a recording head, has not been known. When designing a protective layer structure, it is necessary to select the material and structure for the protective layer in consideration of the various features required of a recording head such as the above described features. In terms of the conventional technologies, the problems regarding the increasing the thickness of the protective layer, and this method is limited where the further improvement in thermal efficiency and further increase in recording speed are concerned (when it comes to the matters of further improving the thermal efficiency and further increasing the recording speed).

SUMMARY OF THE INVENTION

The present invention was made in consideration of the above described various problems concerning the protective layer for the thermally interactive portions of a recording head. Thus, the primary object of the present invention is to provide an ink-jet recording head having such a protective layer that is resistant to shocks, heat, and ink, is resistant to acidity, and is highly durable, by solving the above described various problems concerning the protective layer of a conventional ink-jet head, in particular, the portion which makes contact with ink.

Another object of the present invention is to provide an ink-jet base board equipped with such a protective layer that is compatible with the dot size reduction for image improvement in terms of preciseness, and high speed driving for high speed recording, and that lasts a long time regardless of ink choice, and to provide an ink-jet head equipped with such a protective layer, and an ink-jet apparatus equipped with such an ink-jet head.

An ink-jet head base board in accordance with the present invention comprises: a piece of substrate; a plurality of heat generating members placed on the substrate, each of which being disposed between a pair of electrodes; and a top portion protecting layer placed on an insulative layer placed on the plurality of heat generating members.

In this ink-jet head base board, the top portion protecting layer is distinctive in that it is formed of amorphous alloy, the composition of which can be expressed by the following formula (I):

$$Ta_{\alpha}Fe_{\beta}Ni_{\gamma}Cr_{\delta} \quad (I)$$

(10 at. % $\leqq\alpha\leqq$30 at. %; $\alpha+\beta<80$ at. %;
$\alpha<\beta$; $\delta>\gamma$; and $\alpha+\beta+\gamma+\delta=100$ at. %)

and also in that it contains the oxides of its compositional components, at least in the portion next to its surface which comes in contact with ink.

Also, an ink-jet head in accordance with the present invention comprises: a plurality of orifices through which liquid is ejected; a plurality of liquid paths which are connected to the plurality of orifices one for one, and have a portion across which the thermal energy for ejecting the liquid is caused to act on the liquid; a plurality of heat generating members for generating the thermal energy; and the top portion protecting layer which covers the plurality of heat generating members, with the interposition of an insulative layer.

In this ink-jet head, the top portion protecting layer is distinctive in that it is formed of amorphous alloy, the composition of which can be expressed by the following formula (I):

$$Ta_{\alpha}Fe_{\beta}Ni_{\gamma}Cr_{\delta} \quad (I)$$

(10 at. %$\leqq\alpha\leqq$30 at. %; $\alpha+\beta<80$ at. %;
$\alpha<\beta$; $\delta>\gamma$; and $\alpha+\beta+\gamma+\delta=100$ at. %)

and also that the surface of the top portion protecting layer, which comes into contact with ink, contains the oxides of its compositional components.

Further, the ink-jet recording unit in accordance with the present invention is distinctive in that it has an ink-jet head structured as described above, and an ink storage portion in which the ink to be supplied to such an ink-jet head is stored.

Further, an ink-jet apparatus in accordance with the present invention is distinctive in that it has an ink-jet head or an ink-jet recording unit, which is structured as described above, and a carriage for moving such an ink-jet head or an ink-jet recording unit, in accordance with recording information.

Further, one of the methods for manufacturing an ink-jet head base board in accordance with the present invention is characterized in that the top portion protecting layer of an ink-jet head base board structured as described above is formed by using a method of sputtering which uses a target formed of metallic alloy containing Ta, Fe, Cr and Ni in a manner to satisfy the above compositional formula, or Formula (I).

Another method for manufacturing an ink-jet head base board in accordance with the present invention is characterized in that the top portion protecting layer of an ink-jet head base board structured as described above is formed by using a method of double element sputtering which uses both a target formed of metallic alloy containing Ta, Fe, Cr and Ni in a manner to satisfy the above compositional formula (I), and a target formed of Ta.

According to one of many aspects of the present invention, even when various inks different in properties are used, the top portion protecting layer, which makes contact with ink, is not corroded, and therefore, it is possible to provide an ink-jet head which has a protective layer superior in shock resistance, heat resistance, ink resistance, and oxidization resistance. The present invention is applicable to an ink-jet head base board provided with a protective layer which lasts a long time in spite of the dot size reduction for the image improvement in terms of preciseness, and the high speed driving for high speed recording. Further, the present invention is also applicable to an ink-jet head unit for an ink-jet apparatus, which comprises an ink storage portion for storing the ink to be supplied to the above described superior ink-jet recording head, as well as an ink-jet apparatus in which such an ink-jet head is installed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
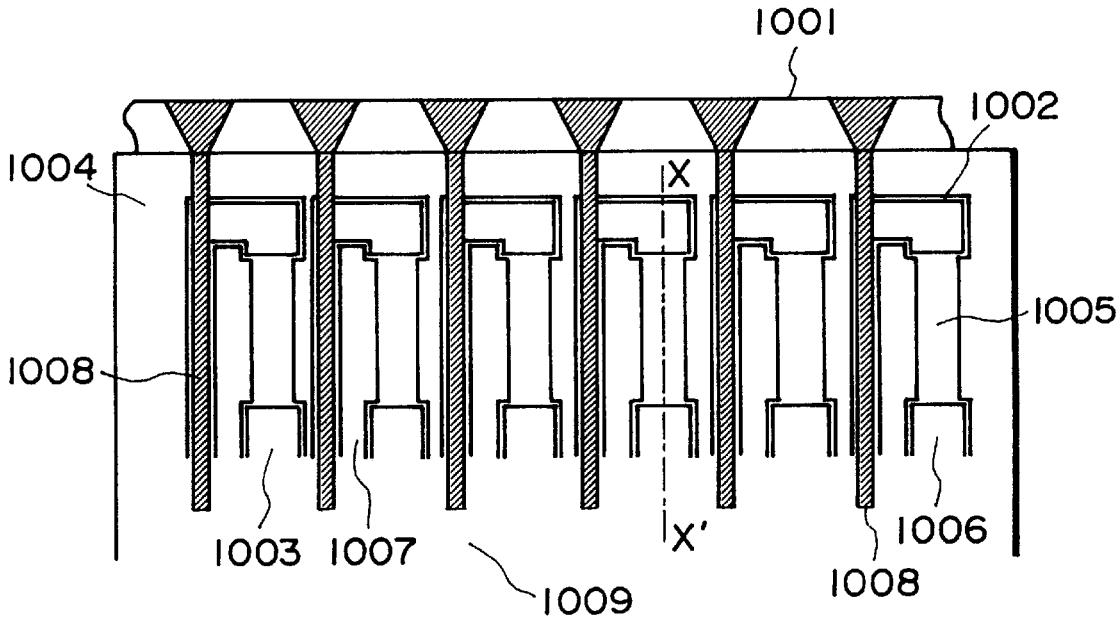
FIG. 1 is a schematic plan of an ink-jet head base board in accordance with the present invention.
Figure 2:
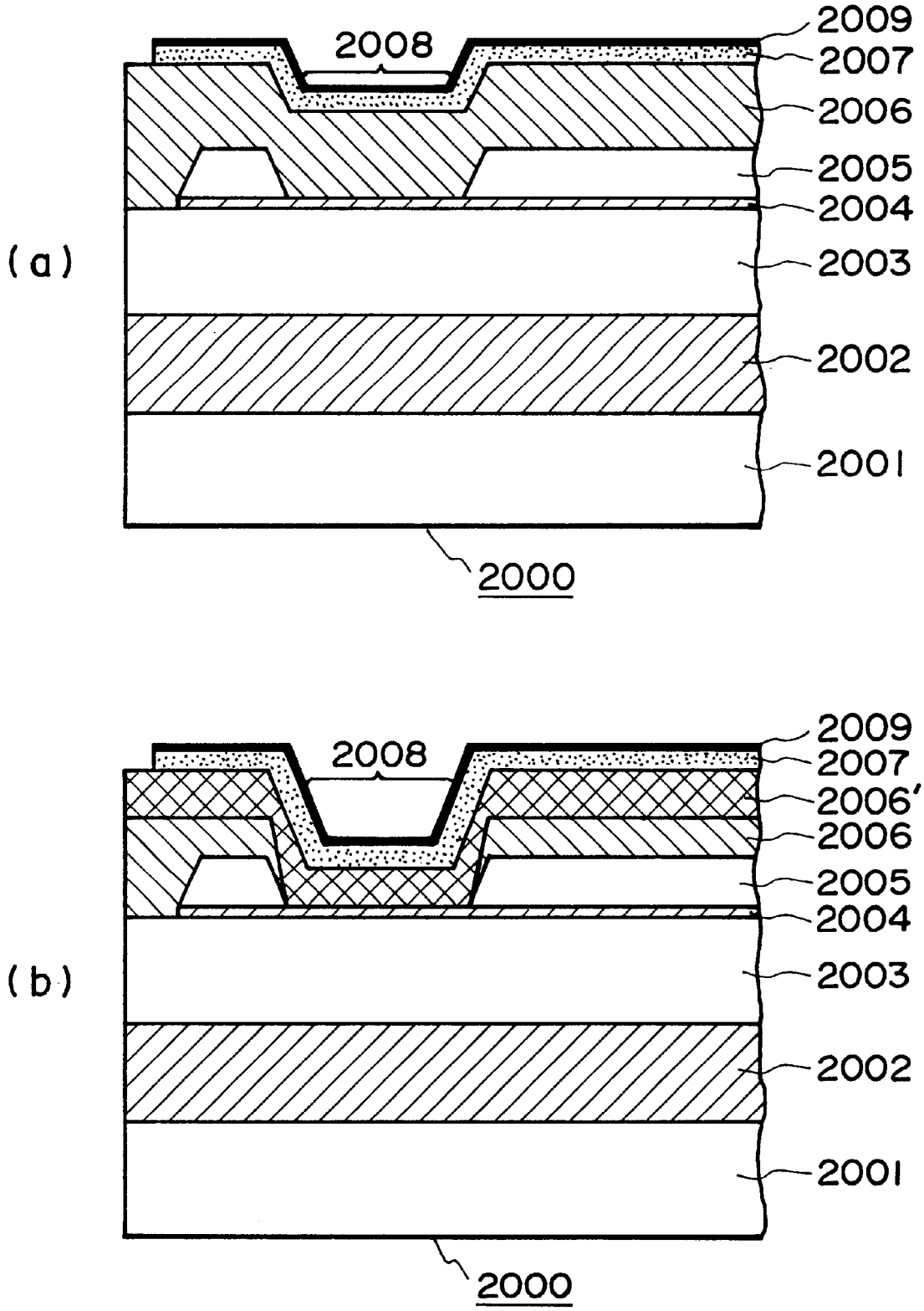
FIG. 2 is a sectional view of a portion of the ink-jet head base board illustrated in FIG. 1; (*a*) being the sectional view at the plane indicated by a single dot chain line X–X', perpendicular to the base board, and (*b*) being a sectional view of a modified version of the ink-jet head base board in FIG. 1, at a plane correspondent to the plane indicated in FIG. 1.

FIG. 1 is a horizontal sectional view of a portion, on the base board side, of an ink-jet head to which the present invention is applicable, at a plane perpendicular to the liquid (ink) path walls. It shows the positioning of the plurality of electrothermal transducers for making ink generate bubbles. FIGS. 2(*a*) and 2(*b*) are sectional views of the ink-jet head base board illustrated in FIG. 1, at a plane indicated by a single dot chain line X–X' in FIG. 1, and another ink-jet head base board, at a plane correspondent to the single dot chain line X–X', respectively.

The ink-jet head illustrated in FIG. 1 has a plurality of ejection orifices 1001, a plurality of ink paths 1003 connected to the plurality of ejection orifices 1001 one for one, and a plurality of electrothermal transducers 1002 disposed on a piece of substrate 1004, corresponding one for one to the plurality of ink paths 1003. Each electrothermal transducer 1002 essentially comprises: an exothermic resistant member 1005; an electrode wiring 1006 for supplying the exothermic resistant member with electrical power; and an insulative film 1007 for protecting the preceding two components. As to the exothermic resistant member, the portion of the exothermic resistant layer 2004, which is between the opposing two electrodes of the electrode layer 2005, which constitute the electrode wiring, and are not covered with the electrode layer, constitutes the exothermic resistant member.

Each ink 1003 path is realized as a top plate (unillustrated), which integrally comprises a plurality of flow path walls, is bonded to the base board, the top plate and base board being aligned with respect to the positional relationship between the plurality of flow path walls and the plurality of electrothermal transducers on the substrate 1004 by a means such as an image processing means. Each ink path 1003 is connected to a common liquid chamber 1009 (partially illustrated), by the end opposite to the ejection orifice side. In the common liquid chamber 1009, the ink supplied from an ink container (unillustrated) is stored. After being supplied into the common liquid chamber 1009, the ink is led into each ink path 1003, and is retained therein, forming a meniscus adjacent to the outward side of the ejection orifice 1001. In this state, the electrothermal transducers 1002 are selectively driven, and the thermal energy generated by the selected electrothermal transducers is used to heat the ink on the thermally interactive portion to make this portion of the ink suddenly boil, so that ink is ejected by the impact of the sudden boiling of the ink.

In FIG. 2(*a*), a referential numeral 2001 stands for a piece of substrate formed of silicon; 2002, a heat storage layer, that is, a thermally oxidized film layer; 2003, an interlayer film layer formed of SiO, SiN, or the like, which also functions as a heat storage layer; 2004, exothermic resistant layer; 2005, an electrode layer, that is, a wiring layer, formed of metallic material such as Al, Al—Si, Al—Cu, or the like; 2006, a protective film layer formed of SiO, SiN, or the like, which also functions as an insulative layer; 2007, a top portion protecting layer for protecting the electrothermal transducer from the chemical and physical shocks resulting from the heat generation by the exothermic resistant member; and a referential numeral 2008 stands for the thermally interactive portion across which the heat generated by the exothermic resistant member, or a portion of the exothermic resistant layer, acts on ink.

Normally, the thickness of the protective layer 2006 structured as illustrated in FIG. 2(*a*) is set within a range of 500 nm–1000 nm.

The thermally interactive portion in an ink-jet head is subjected to not only the high temperature resulting from the heat generation by an exothermic resistant member, but also the cavitation shocks resulting from the development and collapse of bubbles in ink, as well as the chemical reaction caused by ink. Thus, the thermally interactive portion is covered with the top portion protecting layer to protect the electrothermal transducer from the cavitation shocks, chemical reaction caused by ink, and the like. This top portion protecting layer which makes contact with ink is required to be superior in heat resistance, mechanical strength, chemical stability, oxidization resistance, alkali resistance, and the like properties. According to the present invention, the top portion protecting layer is formed of amorphous alloy, the chemical composition of which is represented by Formula (I) given above.

A symbol $\alpha$ in Formula (I) is desired to satisfy the following inequality: 10 at. % $\leqq\alpha\leqq$20 at. %. Further, it is desired that the following inequalities are satisfied: $\delta$>7 at. % and $\delta$>15 at. %, preferably. $\gamma\leqq$8 at. % and $\delta$>17 at. %. On the other hand, the thickness of the top portion protecting layer is desired to be within a range of 10–500 nm, preferably, 50–200 nm.

In this amorphous alloy film, the amount of Ta is set within a range of 10 at. %–20 at. %, which is lower than that in the conventional Ta alloy. Using a composition in which the ratio of Ta is in such a low range passivates the amorphous alloy, significantly reducing the number of crystal boundaries, that is, the points from which corrosion starts, and therefore, maintaining the cavitation resistance at a desirable level, while raising the level of ink resistance. Further, in the portion immediately within the surface of the amorphous alloy film, oxides of the constituent components of the amorphous alloy film are present, or preferably, the surface of the amorphous alloy film is covered with film of the oxides of the constituent components of the amorphous alloy film. In other words, it is desired that the surface of the top portion protecting layer formed of this amorphous alloy is coated with the film of the oxides of the constituent components of the amorphous alloy layer, at least across the surface which makes contact with ink. The thickness of this oxide layer is desired to be no less than 5 nm, and no more than 30 nm.

Forming the oxide film (oxide layer 2009 in FIG. 2(*a*)), the main ingredient of which is Cr, on the surface of the top portion protecting layer makes it possible to prevent the various portions below the oxide film from being corroded by ink, regardless of ink type, that is, even if ink contains such as ingredient as Ca or Mg capable of forming bivalent metallic salt or chelate complex, because the oxidization of the above described amorphous alloy passivates the alloy.

As for the method for forming the aforementioned oxide film, the main component of which is Cr, there is a method which thermally processes the top portion protecting layer in the atmospheric air or ambience of oxygen. For example, the top portion protecting layer may be heat treated at a temperature in a range of 50° C.–200° C. in an oven, or, after forming the top portion protecting layer using a sputtering apparatus, oxygen gas may be introduced into the sputtering apparatus and heated to form the oxide film. Further, the oxide film may be formed by driving an ink-jet head with the application of pulses after the formation the ink-jet head.

The top portion protecting layer sustains stress, in particular, compression stress, and the magnitude of this stress is desired to be no more than $1.0\times10^{10}$ dyne/cm$^2$.

FIG. 2(*b*) shows a vertical section of an improved version of the ink-jet head shown in FIG. 2(*a*). In this version, the protective layer has been divided into two sub-layers, and the thickness (distance from the thermally interactive portion to the exothermic resistant layer) of the protective layer has been reduced across the region below the thermally interactive portion, so that the thermal energy from the exothermic resistant layer more effectively acts on ink in the thermally reactive portion. In other words, first, a first protective sub-layer 2006 was formed of SiO, SiN, or the like, while preventing the first protective sub-layer 2006 from forming the across the thermally interactive portion, by patterning or the like, and then, a second protective layer 2006' was formed of SiO, SiN, or the like, so that the thickness of the protective layer across the thermally interactive portion became thinner compared to the surrounding area. Lastly, the top portion protecting layer 2007 was formed. Reducing the thickness of the protective layer across the thermally interactive portion as described above makes it possible for the thermal energy from the exothermic resistant layer 2004 to be conducted to ink through the second protective sub-layer 2006' and top portion protecting layer 2007, and therefore, the thermal energy can be more efficiently used.

The various portions in the above described structure can be formed using any of the well established methods. The top portion protecting layer 2007 can be formed using any of various film forming methods. However, normally, it is formed using magnetron sputtering which uses a high frequency (RF) power source or a direct current (DC) power source.

Figure 4:
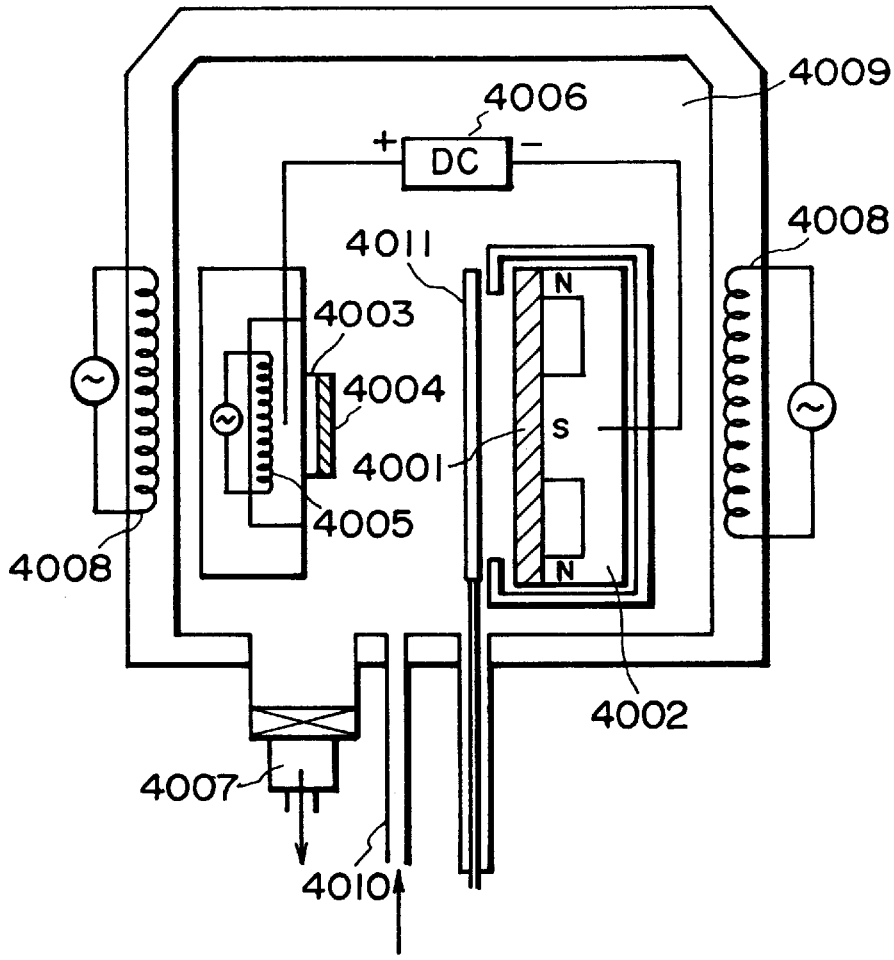
FIG. 4 is a schematic drawing of a film forming apparatus for forming each of the various layers of an ink-jet recording head in accordance with the present invention.

FIG. 4 shows the essential configuration of a sputtering apparatus for forming the top portion protecting layer. In FIG. 4, a referential numeral 4001 stands for a target formed of Ta—Fe—Cr—Ni alloy composed so that an amorphous alloy layer which meets a predetermined compositional ratio, in other words, satisfies the compositional formula, that is, Formula (I) given above, can be formed; 4002, a flat magnet; 4011, a shutter for controlling the film formation on the substrate; 4003, a substrate holder; and a referential numeral 4006 stands for an electrical power source connected to the target 4001 and substrate holder 4003. Also in FIG. 4, a referential numeral 4008 stands for an external heater which is disposed along the external surface of a film formation chamber 4009. The external heater 4008 is used to control the ambient temperature of the internal space of the film formation chamber 4009. On the back side of the substrate holder 4003, an internal heater for controlling the substrate temperature is placed. It is preferable that the temperature of the substrate 4004 is controlled by a combination of the internal heater 4005 and external heater 4008.

The film formation, which uses the apparatus illustrated in FIG. 4, is carried out as follows. First, the film formation chamber 4009 is exhausted to a level in a range of $1\times10^{-5}$–$1\times10^{-6}$ Pa by a vacuum pump 4007. Then, argon gas is introduced into the film formation chamber 4009 through a mass flow controller (unillustrated) and a gas introduction opening 4010. During this introduction of argon gas, the internal and external heaters 4005 and 4008 are adjusted so that the substrate temperature and internal ambience temperature of the film formation chamber 4009 reach a predetermined level. Next, power is applied to the target 4001 from the power source 4006 to trigger the electrical discharge (sputtering discharge), while adjusting a shutter 4011, so that a thin film is formed on the substrate 4004.

The method for forming the top portion protecting layer does not need to be limited to the sputtering which uses the aforementioned target formed of Ta—Fe—Cr—Ni alloy. Instead, a simultaneous dual target sputtering, that is, a method of sputtering in which two separate targets, one formed of Ta and the other formed of Fe—Cr—Ni alloy, are used, and power is applied from two separate power sources connected to them one for one. In this method, the power applied to each target can be individually controlled.

Also as described above, keeping the substrate heated to a temperature within a range of 100–300° C. when forming the top portion protecting layer results in a higher level of film adhering force between the top portion protecting layer and the layer below. Further, using a film formation method of sputtering, which forms particles with a relatively large amount of kinetic energy, as described above, also makes it possible to generate a higher level of film adhering force.

As to the film stress, giving the top portion protecting layer at least a small amount of compression stress, that is, a compression stress of no more than $1.0\times10^{10}$ dyne/cm$^2$, also generates a high level of film adhering force. The amount of the film stress can be adjusted by properly adjusting the amount of the flow of argon gas introduced into the film formation apparatus, the amount of the power applied to the target, and the temperature level to which the substrate is heated.

Whether the protective layer, on which the top portion protecting layer is formed, is thick or thin, the top portion protecting film layer formed of amorphous alloy in accordance with the present invention is compatible with the protective layer on which it is formed.

Figure 6:
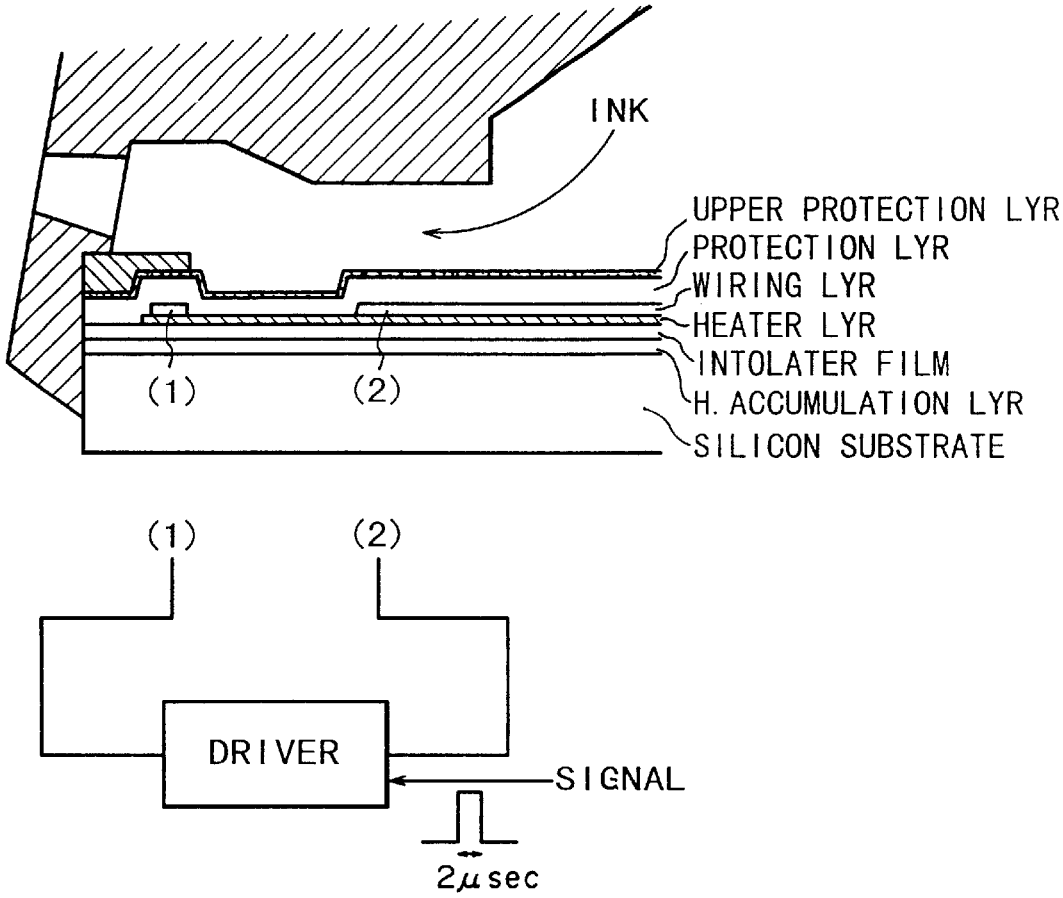
FIG. 6 is a vertical section of an example of an ink-jet recording head in accordance with the present invention.

FIG. 6 is a schematic vertical sectional view of an example of an ink-jet head having a top portion protecting layer in accordance with the present invention, and depicts the general structure of the head. Referring to FIG. 6, after being supplied from an ink container (unillustrated), ink is heated and boils in the thermally interactive portion, and as a result, ink is ejected. During this process, pulses with controlled specifications are applied to the exothermic resistant layer, by a driving means.

Figure 8:
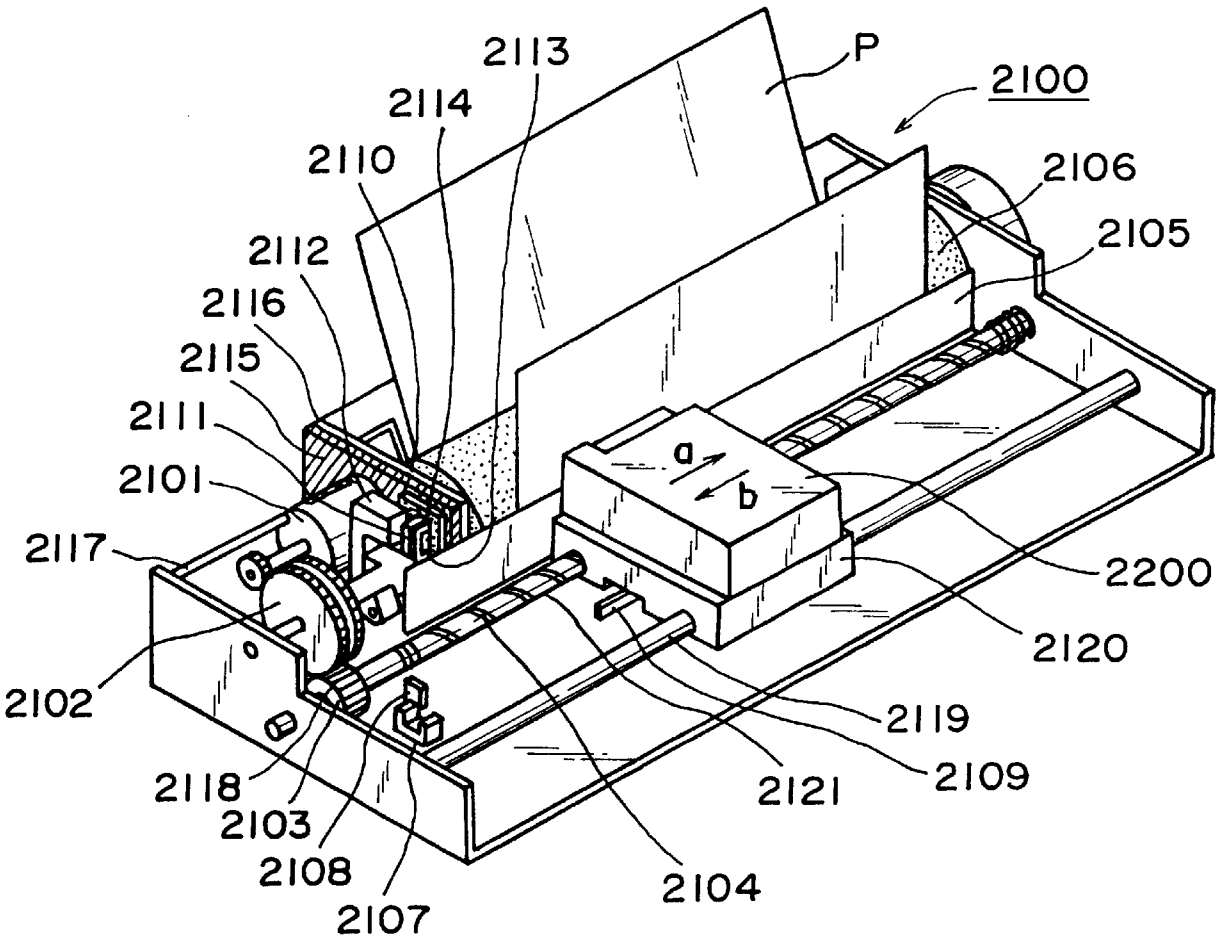
FIG. 8 is a schematic perspective view of an example of an ink-jet recording apparatus equipped with a recording head in accordance with the present invention.

FIG. 8 is an external view of an example of an ink jet apparatus to which the present invention is applicable. In this apparatus, the ink-jet head in accordance with the present invention is mounted on a carriage 2120, a portion of which is engaged in a spiral groove 2121 of a lead screw 2104 which is rotated forward or in reverse by a driver motor 2101 which rotates forward or in reverse, through driving force transmission gears 2102 and 2103. The ink-jet head is shuttled in the directions indicated by a pair of arrow marks a and b, along with the carriage 2120, by the driving force of the driver motor 2101. Designated by a referential numeral 2105 is a paper pressing plate which keeps pressed upon a platen 2106 across the entire range of the platen 2106 in terms of the direction in which the carriage is shuttled, a recording paper P which is conveyed onto the platen 2106 by an unillustrated recording medium conveying apparatus.

Designated by referential numerals 2107 and 2108 are two essential portions of a photocoupler, which constitutes a home position detecting means, along with a lever 3109 of the carriage 2120 for example, as the presence of this lever 2109 is detected by the photocoupler, the rotational direction of the driver motor 2101 is switched. A referential numeral 2110 stands for a member for supporting a capping member 2111 for capping a recording head 2200 across the entirety of its ink ejecting surface; 2112, a suctioning means for suctioning the inside of the capping member 2111 so that the inside of the recording head 2200 is suctioned through a hole running through the capping member 2111, to restore the performance of the recording head 2200; 2114, a cleaning blade; and a referential numeral 2115 stands for a blade moving member which makes it possible for the cleaning blade 2114 to move frontward or rearward. Those items listed in this paragraph are all supported by a supporting plate 2116 on the apparatus main assembly side. The cleaning blade configuration does not need to be limited to that of the cleaning blade 2114; a cleaning blade of any known configuration may be mounted on the supporting member on the main assembly side, which is obvious.

A referential numeral 2117 stands for a lever for starting a suctioning operation for restoring the recording head performance, which is moved by the movement of a cam 2118 engaged with the lead screw 2104, and the movement of which is controlled by a known power transmitting means, such as a clutch, which controls the driving force from the driver motor 2101. A recording control section (unillustrated) which sends signals to the heat generating portion in the recording head 2200, and also controls the driving of each of the above described mechanisms is provided on the recording apparatus main assembly side.

In the ink-jet recording apparatus 2100 having a structure such as the one described above, the recording head 2200 records images on the recording sheet P conveyed onto the platen 2106 by the aforementioned recording medium conveying apparatus, while shuttling across the entire width of the recording paper P. Since the recording head used in this recording apparatus 2100 is one of those manufactured using the above described method, it is therefore capable of recording precisely and at a high speed.

Embodiments

Hereinafter, the present invention will be described in more detail with reference to the examples of the amorphous alloy film formation, the ink-jet head having a top portion protecting layer formed of the aforementioned amorphous alloy, and the like. The present invention is not to be limited by the following embodiments.

Film Formation Example 1

In the following tests, an amorphous alloy film layer equivalent to the top portion protecting layer was formed on a piece of silicon wafer using the apparatus illustrated in FIG. 4, along with the above described film forming method. Then, the properties of the formed amorphous alloy film were evaluated. The description of the film forming operation, and the results of the evaluation of the formed amorphous alloy film will be given below.

<Film Forming Operation>

First, the surface of a single crystal silicon wafer is thermally oxidized, and this silicon wafer (substrate 4004) was placed on the substrate holder 4003 in the film formation chamber 4009 of the apparatus illustrated in FIG. 4. Next, the interior of the film formation chamber 4009 was evacuated to a level of $8\times10^{-6}$ Pa by a vacuum pump 4007. Thereafter, argon gas was introduced into the film formation chamber 4009 through the gas introduction opening 4010, and the ambience condition within the film formation chamber 4009 was adjusted to the following.

[Film Formation Condition]

Substrate temperature: 200° C.

Ambience (gas) temperature in film formation chamber: 200° C.

Gas mixture pressure in film formation chamber: 0.3 Pa

Next, four pieces (film samples 1–4) of 200 nm thick films, the compositions of which could be expressed by a formula of TaαFeβNiγCrδ, were formed on the thermally oxidized film of the silicon wafer, using the above described method of dural target sputtering, in which a target formed of Ta and a target formed of Fe—Ni—Cr—Ni alloy ($Fe_{74}Ni_8Cr_{18}$) are employed, and the power applied to the Ta target was fixed, whereas the power applied to the Fe—Ni—Cr alloy target was rendered variable.

<Evaluation of Film Properties>

Figure 5:
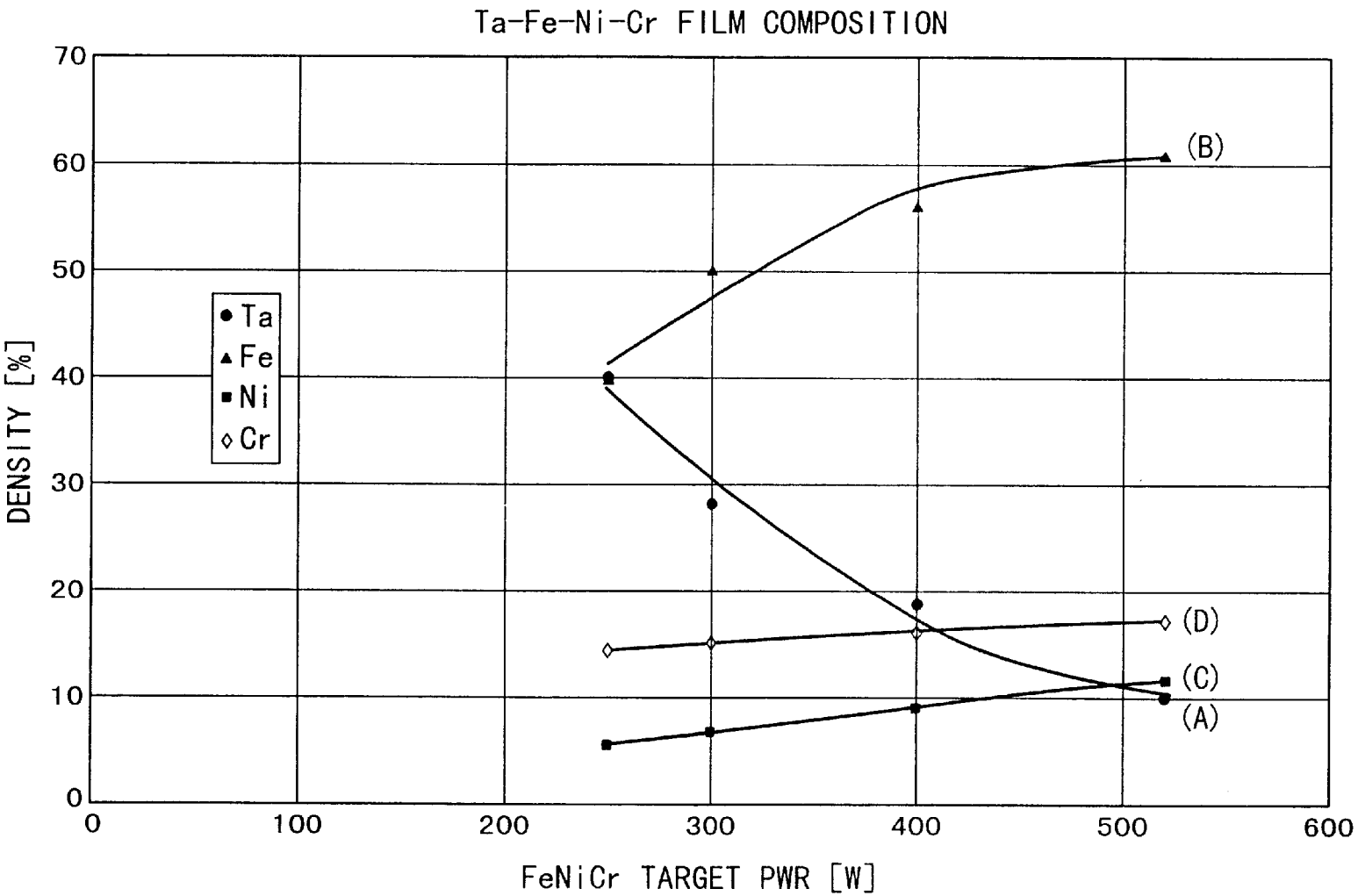
FIG. 5 is a graph which shows the film composition values of the top portion protecting layer in accordance with the present invention.

The thus obtained film samples 1–4 were analyzed using RBS (Rutherford Rearward Scattering) to obtain the values of α, β, γ and δ in the formula of TaαFeβNiγCrδ. The results are shown in Table 1 and FIG. 5. FIG. 5 shows the compositional ratios (densities) of four metals relative to the power applied to the Fe—Ni—Cr alloy target (power applied to Ta target was fixed). Curved lines (A), (B), (C) and (D) represent the densities of Ta, Fe, Ni and Cr, correspondingly. It became evident from FIG. 5 that the greater the power applied to the Fe—Ni—Cr alloy target, the higher the densities of Fe, Cr and Ni in the obtained film.

Next, the X-ray diffraction of the top portion protecting layer, or the TaαFeβNiγCrδ film, formed on the substrate 4004 as described above, was measured for the purpose of structural analysis. The results of the structural analysis showed that the smaller the amount of Ta, the broader the diffraction peak, meaning that the higher in the degree of amorphousness.

<Film Stress>

Next, the film stress in each film sample was measured as the amount of deformation which occurred between the beginning and end of the film formation. The results showed the tendency that the greater the compositional ratio of Fe—Cr—Ni alloy became, the greater the amount of the tensional stress became compared to the amount of the compressional stress, meaning that the smaller the film adhering force because. For example, in the case of the film sample 1, it showed a sign of the presence of at least compressional stress, and when the compressional stress was made no more than $10\times10^{10}$ dyne/cm$^2$, strong film adhesive force was obtained.

TABLE 1

| | Power [W] | | |
|---|---|---|---|
| Samples | Ta | Fe74Ni8Cr18 | Film composition |
| 1 | 300 | 520 | Ta10Fe61Ni12Cr17 |
| 2 | 300 | 400 | Ta19Fe56Ni9Cr16 |
| 3 | 300 | 300 | Ta28Fe50Ni7Cr15 |
| 4 | 300 | 250 | Ta40Fe40Ni6Cr14 |

Embodiment 1

<Evaluation of Suitability of Film Samples as Top Protecting Layer of Ink-jet>

The substrate of the samples evaluated to determine the characteristics of the ink-jet in this embodiment was a piece of plane Si substrate, or a piece of Si substrate on which a driver IC had been already built in. In the case of the plane Si substrate, the heat storage layer 2002 (FIG. 2(*b*) ), that is, a 1.8 μm thick layer of $SiO_2$, was formed thereon by such a method as thermal oxidization, sputtering, CVD, or the like. In the case of the Si substrate with the IC, the heat storage layer, or the $SiO_2$ layer, was formed similarly to the case of the Plane Si substrate, during its manufacturing process.

Next, an interlayer insulative film 2003, that is, a 1.2 μm thick film of $SiO_2$, was formed by sputtering, CVD, or the like methods. Next, the exothermic resistant layer 2004, that is, a 500 nm thick $Ta_{35}Si_{22}N_{43}$ alloy layer, was formed by a method of reactive sputtering using a target formed of Ta—Si alloy. During the formation of this exothermic resistant layer, the substrate temperature was kept at 200° C. Then, an 550 nm thick Al film as the electrode wiring layer 2005 was formed by sputtering.

Next, a pattern was formed by photolithography, and the thermally interactive portion 2008 with a size of 20 μm×30 μm, from which the Al film was removed, was formed. Next, an insulative layer, that is, an 800 nm thick film of SiO, was formed as the first protective sub-layer 2006 by plasma CVD, while preventing the insulative layer from being formed across the thermally interactive portion, by patterning. Then, another insulative layer, that is, a 200 nm thick film of SiN, was formed as the second protective sub-layer 2006' by plasma CVD. Lastly, a 150 nm thick film of TaαFeβNiγCrδ alloy, the compositional ratio of which is shown in Table 2, was formed as the top portion protecting layer 2007 by sputtering. In other words, the ink-jet head base board having the structure illustrated in FIG. 2(*b*) was formed by photolithography.

The thus manufactured ink-jet head base board was used to produce an ink-jet head. FIG. 6 is a schematic vertical sectional view of an example of an ink-jet head having a top portion protecting layer in accordance with the present invention, and depicts the general structure of the head. In FIG. 6, after being supplied from an ink container (unillustrated), ink is heated and boils in the thermally interactive portion, and as a result, ink is ejected. During this process, pulses with controlled specifications are applied to the exothermic resistant layer, by a driving means.

These ink-jet heads were tested for endurance. In these tests, the ink-jet heads were continuously driven with pulses with a driving frequency of 10 kHz and a width of 2 μsec until they became unable to eject any more, to test the lengths of their service lives. The driving voltage Vop was set at 1.3×Vth, Vth being the threshold voltage at which ink boils intensely enough for ejection. As for the ink, ink which contained bivalent metallic salt including nitrate radicals ($Ca(NO_3)_2.4H_2O$), by approximately 4%, was used.

As is evident from Table 2, even after the continuous application of $2.0\times10^9$ pulses, the head was capable of consistent ejection.

After the endurance tests, these ink-jet heads were disassembled and examined. The examination revealed that the top portion protecting layers had not been corroded at all, proving that the top portion protecting layer formed of TaαFeβNiγCrδ alloy had excellent durability. It is reasonable to think that this resulted from the fact that an approximately 20 nm thick oxide film mainly consisting of Cr had been created across the surface of the top portion protecting layer, which was revealed through the analysis of the cross section of the top portion protecting layer, and that this oxide film, which was in passive state, was effective to prevent corrosion.

Comparative Example 1

Figure 7:
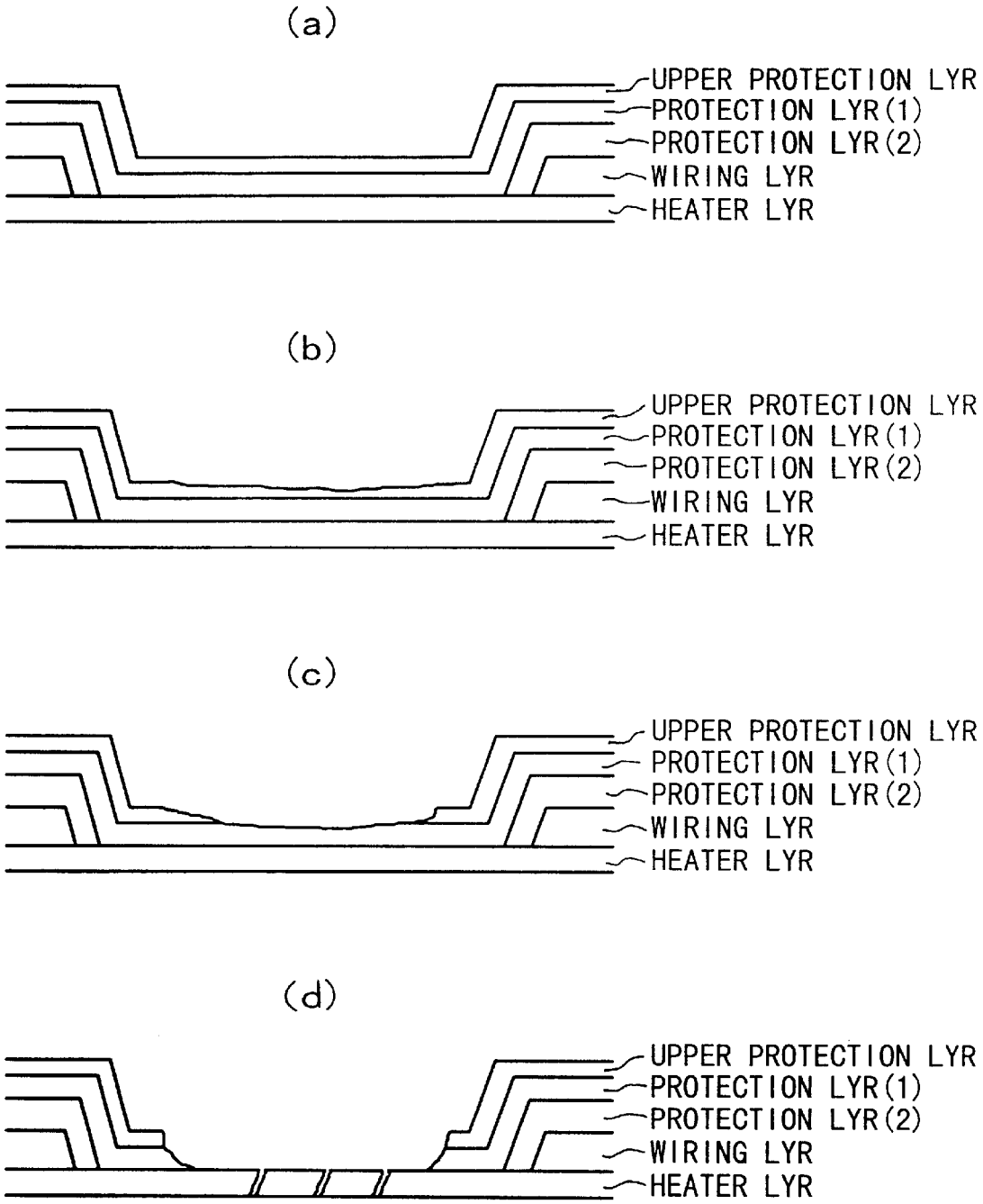
FIG. 7 is a schematic sectional view of the thermally interactive portion of an ink-jet recording head prior to, during, and after a durability test; (*a*)–(*d*) representing various stages of the corrosion across the thermally interactive portion.

Ink-jet heads which were identical to those in the first embodiments except that the top portion protecting layers were formed of Ta were produced, and these ink-jet heads were also tested for endurance like those in the first embodiment. The results are given Table 2. As is evident from Table 2, in the case of Comparative Example 1, the head became usable to eject after approximately $3.0\times10^7$ pulses. Thus, a plurality of ink-jet heads identical to those which ad failed after $30\times10^7$ pulses were subjected to the continuous application of $5.0\times10^6$, $1.0\times10^7$ or $3.0\times10^7$ pulses, and were disassembled for examination. FIGS. 7(*a*)–7(*d*) are schematic sectional views of the thermally interactive portions, each representing an ink-jet head different from the other in the number of the driving pulses to which they were subjected, and shows the changes which occurred to the thermally interactive portion, in relation to the number of the applied pulses. As is evident from FIGS. 7 (*a*)–7(*d*), the greater the number of the pulses, the more advanced the state of the corrosion in the top portion protecting layers. In the case of the ink-jet head from which ink was continuously ejected until the number of the pulses reached $3.0\times10^7$, the corrosion had reached the exothermic resistant layer, creating breakage in the layer.

Embodiments 2–5

Ink-jet heads, which were identical to those in the first embodiment except that the top portion protecting layers 2007 were given the compositions and thicknesses shown in Table 2, were produced, and were tested for endurance like those in the first embodiment. The results are given in Table 2.

Comparative Examples 2–5

Ink-jet heads, which were identical to those in the first embodiment except that the top portion protecting layers 2007 were given the compositions and thicknesses shown in Table 2, were produced.

These ink-jet heads were tested for endurance like those in the first embodiment. The results are given in Table 2. As is evident from the case of Comparative Example 2 in Table 2, increasing the thickness of the top portion protecting layer formed of Ta did not result in significant improvement. In the cases of Comparative Examples 3–5, it was impossible for the ink-jet heads to maintain their normal ejection performance to the end of the continuous application of $2.0\times10^8$ pulses.

After the endurance tests, these ink-jet heads were disassembled for examination. The examination revealed that the top portion protecting layers had been corroded, and that in some of the heads, the corrosion had reached the exothermic resistant layer, breaking the exothermic resistant layer.

Embodiments 6–9

Ink-jet heads, which were identical to those in the first embodiment except that the top portion protecting layers were formed using a method of sputtering in which a target formed of Ta—Fe—Cr—Ni alloy with a predetermined composition (atomic composition ratio), were used along with argon gas. The top portion protecting layers of these ink-jet heads were given the compositions and thicknesses shown in Table 2. These ink-jet heads were tested for endurance like those in the first embodiment. The results are given in Table 2.

The following became evident from the tests. That is, it became evident from the results given in Table 2, that the length of the printing life of a head depended on the compositional ratios among Ta, Fe, Ni and Cr within the top portion protecting layer, in particular, that the greater the ratio of Fe—Cr—Ni, the longer the length of the printing life of an ink-jet head; in other word, in the composition TaαFeβNiγCrδ of the top portion protecting layer, the following requirement was satisfied:

$$10 \text{ at. } \% \leqq \alpha \leqq 30 \text{ at. } \%;$$

$$\alpha+\beta<80 \text{ at. } \%;$$

$$\alpha<\beta;$$

$$\delta>\gamma;$$

and $$\alpha+\beta+\gamma+\delta=100 \text{ at. } \%.$$

The thickness of the top portion protecting layer was desired to be no less than 10 nm and no more than 500 nm, because when it was no more than 10 nm, the protective function of the top portion protecting layer was sometimes not strong enough against ink, and when it was no less than 500 nm, the energy from the exothermic resistant layer sometimes could not be efficiently conducted to ink.

In some of the above described embodiments, excellent durability could be realized even when the thickness of the top portion protecting layer was no more than 150 nm. As for the film stress, a large amount of film adhering force could be yielded when at least compressional stress was present, and its magnitude was no more than $1.0\times10^{10}$ dyne/cm$^2$.

TABLE 2

| | Film composition (at. %) | Ta + Fe | Film thickness (nm) | Durable pulses | Upper protect. LYR |
|---|---|---|---|---|---|
| Emb. 1 | Ta18Fe57Ni8Cr17 | 75 | 150 | $\geqq 2.0\times10^9$ | NO SCRAPE |
| Emb. 2 | Ta15Fe58Ni9Cr18 | 73 | 150 | $\geqq 2.0\times10^9$ | NO SCRAPE |
| Emb. 3 | Ta12Fe59Ni9Cr20 | 71 | 50 | $\geqq 2.0\times10^9$ | NO SCRAPE |
| Emb. 4 | Ta14Fe55Ni12Cr19 | 69 | 100 | $\geqq 2.0\times10^9$ | NO SCRAPE |
| Emb. 5 | Ta28Fe50Ni7Cr15 | 78 | 150 | $\leqq 8.0\times10^8$ | SLIGHTLY SCRAPED |
| Emb. 6 | Ta19Fe57Ni9Cr15 | 76 | 150 | $\geqq 2.0\times10^9$ | NO SCRAPE |
| Emb. 7 | Ta11Fe60Ni8Cr21 | 71 | 200 | $\geqq 2.0\times10^9$ | NO SCRAPE |
| Emb. 8 | Ta16Fe55Ni9Cr20 | 71 | 250 | $\geqq 2.0\times10^9$ | NO SCRAPE |
| Emb. 9 | Ta22Fe54Ni7Cr17 | 76 | 150 | $\leqq 1.0\times10^9$ | SLIGHTLY SCRAPED |
| Comp. Ex. 1 | Ta | 100 | 150 | $\leqq 3.0\times10^7$ | SCRAPED |
| Comp. Ex. 2 | Ta | 100 | 230 | $\leqq 4.5\times10^7$ | SCRAPED |
| Comp. Ex. 3 | Ta35Fe45Ni7Cr13 | 80 | 150 | $\leqq 2.0\times10^8$ | SCRAPED |
| Comp. Ex. 4 | Ta40Fe41Ni5Cr14 | 81 | 150 | $\leqq 2.0\times10^8$ | SCRAPED |
| Comp. Ex. 5 | Ta31Fe45Ni14Cr10 | 76 | 150 | $\leqq 2.0\times10^8$ | SCRAPED |

While the invention has been described with reference to the structures disclosed herein, it is not confined to the details set forth and this application is intended to cover such modifications or changes as may code within the purposes of the improvements or the scope of the following claims.

What is claimed is:

1. A base member for an ink jet head, said base member comprising a substrate, a heat generating resistor provided between electrodes which constitute a pair on said substrate an upper protection layer provided on an insulation layer which in turn is provided on the heat generating resistor, said upper protection layer having a contact surface contactable to ink, in the improvement residing in that said upper protection layer is made of amorphous alloy having a following composition formula:

$$Ta\alpha Fe\beta Ni\gamma Cr\delta=(1)$$

where 10 atomic % $\leqq\alpha\leqq$30 atomic %, $\alpha+\beta<80$ atomic % $\alpha<\beta$, $\delta>\gamma$ and $\alpha+\beta+\gamma+\delta=100$ atomic %, and at least the contact surface of said upper protection layer contains an oxide of a constituent component, wherein a film stress in said upper protection layer includes at least compression stress, which is not more than $1.0\times10^{10}$ dyne/cm$^2$.

2. A method of manufacturing a base member for an ink jet head according to claim 1, the improvement residing in that said upper protection layer is produced by a sputtering method using an alloy target comprising Ta, Fe, Cr, and Ni for providing said composition.

3. The method according to claim 2, further comprising a step of oxidizing a surface of the amorphous alloy film produced by a sputtering method to coat the surface with the oxide film.

4. The method according to claim 3, wherein the oxide film is produced by heat oxidation.

5. The method according to claim 4, wherein a film stress of the amorphous alloy film during formation of the film includes a compression stress and is not more than $1.0\times10^{10}$ dyne/cm$^2$.

6. The method according to claim 2, wherein a film stress of the amorphous alloy film during formation of the film includes a compression stress and is not more than $1.0\times10^{10}$ dyne/cm$^2$.

7. The method according to claim 3, wherein a film stress of the amorphous alloy film during formation of the film includes a compression stress and is not more than $1.0\times10^{10}$ dyne/cm$^2$.

8. A method of manufacturing a base member for an ink jet head according to claim 1, the improvement residing in that said upper protection layer is produced by a binary sputtering method using an alloy target comprising Fe, Cr, and Ni for providing a composition and a Ta target.

9. The method according to claim 8, further comprising a step of oxidizing a surface of the amorphous alloy film produced by a sputtering method to coat the surface with the oxide film.

10. The method according to claim 9, wherein the oxide film is produced by heat oxidation.

11. The method according to claim 10, wherein a film stress of the amorphous alloy film during formation of the film includes a compression stress and is not more than $1.0\times10^{10}$ dyne/cm$^2$.

12. The method according to claim 9, wherein a film stress of the amorphous alloy film during formation of the film includes a compression stress and is not more than $1.0\times10^{10}$ dyne/cm$^2$.

13. The method according to claim 8, wherein a film stress of the amorphous alloy film during formation of the film includes a compression stress and is not more than $1.0\times10^{10}$ dyne/cm$^2$.

14. An inkjet head comprising an ejection outlet for ejecting liquid, a liquid flow path having a portion for applying to the liquid thermal energy for ejecting the liquid, a heat generating resistor for generating the thermal energy and an upper protection layer covering the heat generating resistor with an insulation layer therebetween, the improvement residing in that said upper protection layer is made of amorphous alloy having a following composition formula $$Ta_{\alpha}Fe_{\beta}Ni_{\gamma}Cr_{\delta}=(1)$$

where 10 atomic % $\leqq\alpha\leqq$30 atomic %, $\alpha+\beta<80$ atomic % $\alpha<\beta$, $\delta>\gamma$ and $\alpha+\beta+\gamma+\delta=100$ atomic %, and such a surface of said upper protection layer as is contactable to ink contains an oxide of a constituent component of said upper protection layer, wherein a film stress in said upper protection layer includes at least compression stress, which is not more than $1.0\times10^{10}$ dyne/cm$^2$.

* * * * *

UNITED STATES PATENT AND TRADEMARK OFFICE

CERTIFICATE OF CORRECTION

PATENT NO. : 6,663,228 B2
DATED : December 16, 2003
INVENTOR(S) : Ichiro Saito et al.

It is certified that error appears in the above-identified patent and that said Letters Patent is hereby corrected as shown below:

Title page,
Item [75], Inventors, "Ichiro Saito, Kanagawa-ken (JP); Masahiko Ogawa, Tokyo (JP); Teruo Ozaki, Kanagawa-ken (JP); Masahiko Kubota, Tokyo (JP); Muga Mochizuki, Kanagawa-ken (JP)" should read -- Ichiro Saito, Yokohama (JP); Masahiko Ogawa, Hino (JP); Teruo Ozaki, Yokohama (JP); Masahiko Kubota, Tokyo (JP); Muga Mochizuki, Yokohama (JP) --.

Figure 3:
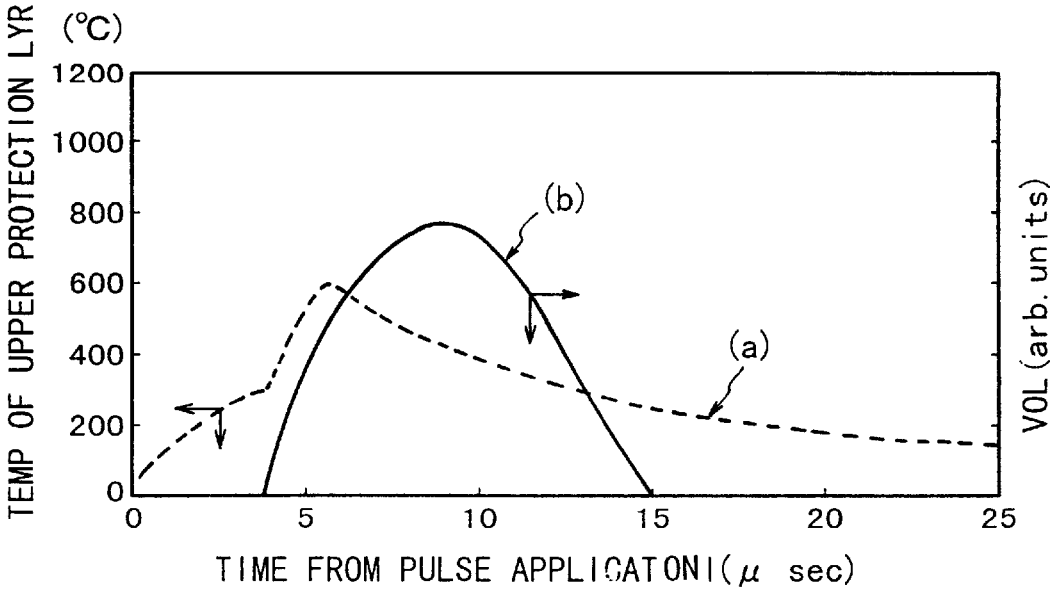
FIG. 3 is a graph which shows the change in the temperature of the top portion protecting layer, and the change in the volume of a bubble, which occur after the voltage application.

Drawings,
Sheet 3, Figure 3, "APPLICATIONI" should read -- APPLICATION --.

Column 1,
Line 20, "configuration" should read -- configurations --; and
Line 43, "boiling, or" should read -- boiling of --.

Column 4,
Line 19, "in" should be deleted;
Line 20, "which than" should read -- than that of --; and
Line 46, "satisfactorily used," should read -- satisfactorily be used, --.

Column 7,
Line 24, "1003 path" should read -- path 1003 --.

Column 8,
Line 16, "preferably. $\gamma \leqq 8$ at. % and $\delta > 17$ at. %." should read -- preferably, $\gamma \geqq 8$ at. % and $\delta \geqq 17$ at. %. --; and
Line 45, "as" (first occurrence) should read -- an --.

Column 10,
Line 51, "constitutes" should read -- constitute --.

Column 11,
Line 46, "is" should read -- was --.

Column 12,
Line 1, "are" should read -- were --; and
Line 30, "because" should read -- became --.

UNITED STATES PATENT AND TRADEMARK OFFICE

CERTIFICATE OF CORRECTION

PATENT NO. : 6,663,228 B2
DATED : December 16, 2003
INVENTOR(S) : Ichiro Saito et al.

It is certified that error appears in the above-identified patent and that said Letters Patent is hereby corrected as shown below:

Column 13,
Line 59, “ad” should read -- had --; and
Line 60, “$30\times10^7$ pulses” should read -- $3.0\times10^7$ pulses --.

Column 14,
Line 55, “word,” should read -- words, --.

Column 15,
Line 42, “code” should read -- come --;
Line 47, “substrate” should read -- substrate, --; and
Line 50, “in” (first occurrence) should be deleted.

Column 17,
Line 7, “formula” should read -- formula: --.

Signed and Sealed this

Sixth Day of July, 2004

JON W. DUDAS
*Acting Director of the United States Patent and Trademark Office*